United States Patent [19]

Fanse et al.

[11] Patent Number: 4,846,088

[45] Date of Patent: Jul. 11, 1989

[54] SYSTEM FOR TRANSPORTING COMPRESSED GAS OVER WATER

[75] Inventors: Vinaykumar R. Fanse, Alameda; Egerton G. Jones, San Francisco; Syed M. Nazar, San Rafael, all of California

[73] Assignee: Marine Gas Transport, Ltd., Bermuda, Bermuda

[21] Appl. No.: 171,981

[22] Filed: Mar. 23, 1988

[51] Int. Cl.[4] ..... B63B 25/14

[52] U.S. Cl. ..... 114/72; 220/3

[58] Field of Search ..... 114/74 R, 72; 220/3; 48/190; 137/899.2

[56] References Cited

U.S. PATENT DOCUMENTS 2,491,013 12/1949 Noll et al. ..... 220/3
4,139,019 2/1979 Bresie et al. ..... 62/55

FOREIGN PATENT DOCUMENTS 1133167 11/1968 United Kingdom ..... 114/74 R

*Primary Examiner*—Sherman D. Basinger
*Attorney, Agent, or Firm*—Townsend and Townsend

[57] ABSTRACT

An over-water compressed gas transport system having a storage vessel disposed only on or above the deck of a seagoing vessel. The storage vessel is fabricated of standard pipeline type pipe.

4 Claims, 1 Drawing Sheet

SYSTEM FOR TRANSPORTING COMPRESSED GAS OVER WATER

BACKGROUND OF THE INVENTION

1. Field of the Invention

The invention relates generally to gas transportation systems and, more particularly, relates to a system for transporting non-liquefied compressed gas over water.

2. Description of the Relevant Art

Several varied distribution systems for natural gas are well known. Pipelines are generally used to economically distribute compressed natural gas (CNG) over land. Pipelines are large systems that require planning, large capital investement, and are subject to regulatory control. Due to this regulatory control, and other factors, pipeline technology is highly standardized and well understood. Pipeline materials, such as standard pipeline type pipe, are used in great quantities and are economically mass produced.

A system for transporting natural gas from "shut in" wells not accessed by a pipeline is disclosed in U.S. Pat. Nos. 4,139,019, 4,213,476, and 4,380,242. Those patents disclose a system for transferring CNG from a shut in well to a delivery point in special containers carried by a truck.

Systems for transporting natural gas over water generally include ships having special vessels on board for storing liquefied natural gas (LNG). The quantity of gas transported is of course much greater if the gas is liquefied. The high cost of building and operating over-water transport can only be recovered by transporting LNG. However, an LNG transport system requires a liquefaction facility at the shipping point and a conversion facility at the delivery point.

In many instances, geography dictates that over water transport is desirable. For example, gas may be transported from a source on one island to a user on another island or inadequate roads and lack of a pipeline make transportation by rivers desirable. However, the amount of gas to be transferred, or other factors, may not justify the costs of liquefaction and liquid handling facilities or the construction of a pipeline. Thus, economical transport of CNG over-water is required.

Several systems have been proposed to implement this type of system. In one system, the above-described CNG truck transport system is transported by barge. Also, a system utilizing special custom-built vessels for storing CNG on the deck of a barge has been proposed.

All of the proposed systems have some drawbacks either in the cost of the system, safety problems, or lack of capacity. However, the various proposals illustrate the need for an economically viable system for over-water transportation of CNG.

SUMMARY OF THE INVENITON

In view of the above, it is an object of the present invention to provide a low-cost, safe over-water CNG transport system.

According to one aspect of the invention, a CNG storage element fabricated from lengths of common pipeline type pipe is disposed only on and above the deck of a seagoing vessel. Because of the low cost and general availability of the pipe, the storage system does not require a large capital investment. Additionally, minor gas leaks are vented to the atmosphere because the storage vessel is disposed on the deck of the seagoing vessel. Thus, any possibility of fire or explosion is obviated.

According to a further aspect of the invention, each length of pipe is capped at each end and fitted with a manifold connector to form a CNG storage element. A manifold distributes compressed gas from a storage facility to the various storage elements at the shipping point and from the various storage elements to a storage facility at a receiving point.

Accordingly, an over-water natural gas transport system for economically transporting natural gas in an environment where gas liquefaction facilities are non-existent or not economically viable is provided. Further, the need for expensive, specially constructed storage vessels is obviated by utilizing low-cost, generally available standard pipeline type pipe.

Other features and advantages of the invention will become apparent in view of drawings and following detailed description.

DETAILED DESCRIPTION OF THE PREFERRED EMBODIMENTS

Figure 1:
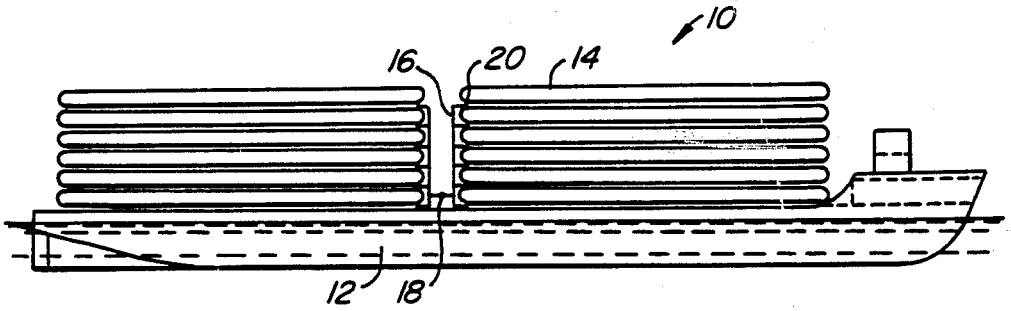
FIG. 1 is a side view of a preferred embodiment of the invention.

Referring now to drawings, where identical or corresponding parts are referred to by the same reference numerals throughout the several views, FIG. 1 is a side view of a preferred embodiment of the invention. In FIG. 1, a CNG storage system 10 is disposed only on and above the deck of a barge 12. The storage system 10 includes several storage elements 14 coupled to a manifold 16. The manifold includes a receiving/delivery port 18 and several transfer ports 20.

Figure 2:
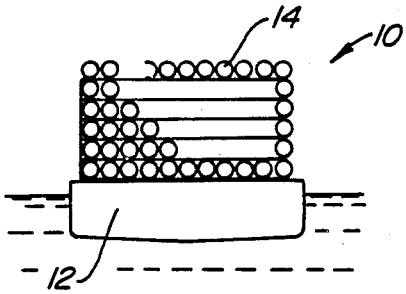
FIG. 2 is a cross-sectional view of the embodiment of FIG. 1.

FIG. 2 is a cross-sectional view of the system of FIG. 1. In FIG. 2, the storage elements 14 are supported by a rigid structure (not shown) affixed to the deck of the barge 12. This structure may be formed of metal shapes or pipes that are welded or bolted together. The height of the storage system 10 is determined by the quantity of gas to be shipped and the stability of the barge.

Figure 3:
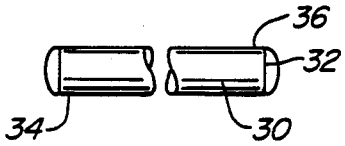
FIG. 3 is a detailed schematic diagram of one storage element.

FIG. 3 is a detailed schematic diagram of one storage element 14. Each element is formed from a length of standard pipeline type pipe 30. The ends of the pipe 30 are sealed by caps 32 welded on the ends of the pipe 30 and a manifold connector 34 and vent 36 are mounted on each pipe 30.

Figure 4:
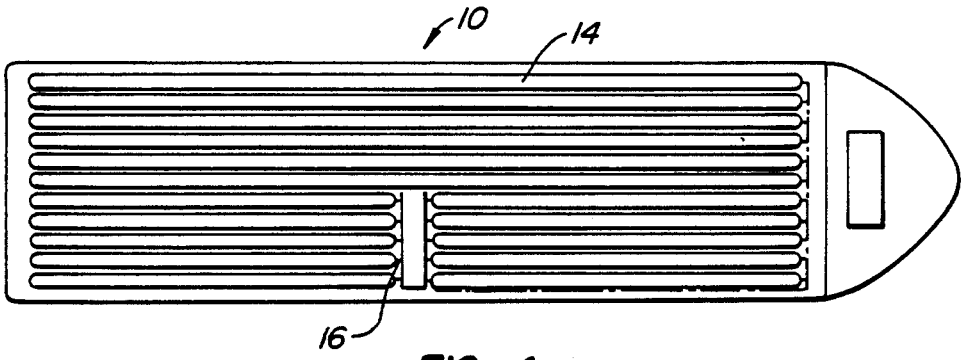
FIG. 4 is a plan view of the embodiment of FIG. 1 and of an alternate embodiment.

FIG. 4 is a plan view of the system. In FIG. 4, two embodiments are shown where the storage elements 14 may be the full length of the barge or half the length. The choice of length may well depend on the length of available pipe. Since cost reduction is a primary advantage of the system it is important to minimize the welding and cutting operations required to construct the system.

The above-described embodiment utilizes standard pipeline pipe with wall thicknesses and yield strength commonly used in the pipeline industry. As described above, this pipe is mass produced and inexpensive. Additionally, because the entire vessel 10 is open to the atmosphere, minor gas leaks will be vented and there is no danger of a gas build-up that could cause a fire or explosion.

In operation, at a shipping facility the receiving /delivery port 18 is coupled to an output line from the shipping facility. A compression facility is used to increase the gas pressure from the receiving pressure in the pipeline to the storage pressure in the pipe type elements 14.

At a delivery point, the receiving/delivery port 18 is coupled to an input line of the receiving facility. The pressure of the stored gas causes gas flow into the receiving storage vessel. Naturally, some residual gas will remain in the storage elements 14. If it is desired to remove this residual gas, a compressor may be utilized to make the residual gas flow into the delivery system.

The arrangement of the storage elements 14 and the structural system for mounting the elements on the barge is determined by safety and marine design factors and is not part of the present invention. Further, although barges may be advantageously utilized other types of ships or vessels may be utilized so long as the storage system 10 is disposed only on the deck of the ship or vessel.

The invention has now been described with reference to preferred embodiments. Substitution of parts and other modifications will now be apparent to persons of ordinary skill in the art. In particular, the transport system of the present invention may be utilized to transport compressed gases other than natural gas. Accordingly, the invention is not intended to be limited except as provided by the appended claims.

What is claimed is:

1. A system for transporting nonliquified compressed natural gas over water from a shipping point to a receiving facility, said system comprising:

a seagoing vessel having a deck;

a compressed gas storage system disposed only on and above said deck so that minor gas leaks are vented to the atmosphere to prevent dangerous gas build-up, said storage system including:

a plurality of lengths of standard oil field pipeline type pipes with each length having first and second ends;

means for capping the first and second ends of each of said lengths of pipe to form a like plurality of storage elements and to prevent leakage of non-liquified compressed natural gas therefrom;

a manifold having a like plurality of transfer ports and a receiving/delivery port, said receiving/delivery port adapted to receive non-liquified compressed natural gas from a shipping port storage facility and to deliver compressed gas to the receiving facility; and means, disposed on each storage element, for connecting said storage element to a respective one of said transfer ports so that non-liquified compressed natural gas may be transported between said receiving/delivery port and said storage elements.

2. The invention of claim 1 wherein said seagoing vessel is a barge and selected ones of said storage elements are rigidly affixed to the deck of said barge.

3. The invention of claim 2 wherein each storage element includes a vent.

4. A method of transporting non-liquified compressed natural gas over water from a shipping facility to a receiving facility comprising the steps of:

coupling a receiving/delivery port to an output line at the shipping facility;

transferring non-liquified compressed natural gas from the shipping facility via said receiving/delivery port to a storage element of a plurality of lengths of standard pipeline-type pipe disposed only on the deck of a seagoing vessel so that minor gas leaks are vented to the atmosphere to prevent dangerous gas build-up and having a cap welded onto each end of said pipes and a manifold connector coupling the receiving/delivery port to one of said caps;

ferrying the seagoing vessel over water to the receiving facility; and coupling the receiving/delivery port to an input line of the receiving facility, the pressure of the stored non-liquified compressed natural gas causing the nonliquified compressed natural gas to move from the storage element to the receiving facility.

* * * * *